US007168866B2

(12) United States Patent
Itoh

(10) Patent No.: US 7,168,866 B2
(45) Date of Patent: Jan. 30, 2007

(54) MULTI-CHAMBER WASHING DEVICE FOR PHOTOSENSITIVE MATERIAL

(75) Inventor: Koji Itoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 64 days.

(21) Appl. No.: 11/009,078

(22) Filed: Dec. 13, 2004

(65) Prior Publication Data

US 2005/0129399 A1 Jun. 16, 2005

(30) Foreign Application Priority Data

Dec. 12, 2003 (JP) ..... 2003-415653

(51) Int. Cl.
*G03D 3/08* (2006.01)
*G03D 13/04* (2006.01)

(52) U.S. Cl. ..... 396/614; 396/620; 396/622; 396/626; 396/636; 355/27; 134/64 P

(58) Field of Classification Search ..... None
See application file for complete search history.

(56) References Cited

U.S. PATENT DOCUMENTS 5,168,296 A 12/1992 Nakamura et al.
5,396,309 A * 3/1995 Morita et al. ..... 396/614
5,754,914 A 5/1998 Van den Bergen et al.
6,652,168 B2 * 11/2003 Hyodo ..... 396/620

FOREIGN PATENT DOCUMENTS

JP 2-130548 A 5/1990
JP 3-110556 A 5/1991
JP 6-67393 A 3/1994

* cited by examiner

*Primary Examiner*—D. Rutledge
(74) *Attorney, Agent, or Firm*—Sughrue Mion, PLLC

(57) ABSTRACT

A washing bath in a photographic paper processor has plural washing chambers for washing photographic paper with washing water by passage of the photographic paper. Plural cell units are coupled with one another vertically by a modular structure. Each of the cell units has one of the washing chambers. A sealing medium of silicone rubber keeps a cell connection portion between the cell units in a liquid-tight state. A blade mechanism is secured to a panel constituting the cell units, allows the photographic paper to pass between the washing chambers, and blocks passage of the washing water. A transporting rack transports the photographic paper serially to pass the washing chambers. The cell connection portion includes a connection surface, disposed to extend horizontally, and separable for removal of the cell units in the vertical direction. The sealing medium is secured to one of two cell units being coupled.

18 Claims, 15 Drawing Sheets

MULTI-CHAMBER WASHING DEVICE FOR PHOTOSENSITIVE MATERIAL

BACKGROUND OF THE INVENTION

1. Field of the Invention

The present invention relates to a multi-chamber washing device for photosensitive material. More particularly, the present invention relates to a multi-chamber washing device for photosensitive material, in which a space for installation can be small by an economized construction of liquid baths.

2. Description Related to the Prior Art

A photographic printer is one of photosensitive material processing apparatuses used in a photo laboratory. A printer-processor composite machine as one type of photographic printer includes an image forming exposure device, a photographic processing bath group, and a drier. The exposure device for image forming prints an image to photographic paper as photosensitive material by exposure. The photographic processing bath group photographically develops the photographic paper. The drier dries the photographic paper being developed. The photographic processing bath group is constituted by plural liquid baths for containing liquids for color development, bleach/fixing, water washing and stabilization. As the photographic paper is transported past the liquid baths serially one after another, the photographic paper is processed suitably.

In a conventional type of photographic processing bath group, a crossover structure is used for transporting the photographic paper from a first one of the adjacent liquid baths to a second of them. The crossover structure causes the photographic paper to travel out of the liquid in the first bath to the atmosphere, and then to travel from the atmosphere to the second bath. In contrast with this, U.S. Pat. No. 5,168,296 (corresponding to JP-A 2-205846), U.S. Pat. No. 5,754,914 (corresponding to JP-A 9-179266), JP-A 2-130548, JP-A 3-110556, and JP-A 6-067393 disclose a newer construction for reducing time of shortening the process time by shortening the path length of the photographic paper. Submerged blade mechanisms are incorporated in respective partitions between the liquid baths. A sealing medium or blade allows passage of the photographic paper between the adjacent baths, but blocks passage of the liquids of the adjacent baths. The photographic paper travels through the photographic processing bath group from one liquid to another without passing the atmosphere.

In general, a final bath among the liquid baths is a washing bath. The vessel for the washing bath is split into plural chambers or compartments by partitions, for example four washing chambers. Washing water is supplied in replenishment through the most downstream one of the washing chambers. The washing water is caused to flow down into upstream ones of the washing chambers, which is a so-called cascade structure of connection. This is effective in reducing an amount of replenishing the washing water because the density of iron in the liquid in the most downstream one of the washing chambers can be reduced. Furthermore, the ability of reducing the replenished amount of the washing water is according to the highness of the number of the washing chambers in the washing bath. As a result, an amount of waste liquid ejected after the washing can be reduced by the reduction of the replenished amount.

To split the washing bath into plural chambers, the washing chambers must be separated in a liquid-tight manner. For example, JP-A 6-067393 discloses a construction in which the sealing medium is incorporated in a bath or tank, and a rack is set to define plural liquid chambers which are liquid-tight. JP-A 3-110556 discloses a construction in which the sealing medium is incorporated in a rack, to define plural liquid chambers which are liquid-tight.

However, there arises a problem in splitting the washing bath with the partition into the plural chambers. In FIGS. 13–15, at least three sealing mechanisms 8*a*, 8*b* and 8*c* are required for sealing partitions 2, 3 and 4 and washing baths 5, 6 and 7. Positioning of those parts is extremely difficult at the time of assembly. It is conceivable to use resin for producing the sealing partitions 2–4, the washing baths 5–7, and mechanical elements for transporting racks (not shown) for transporting the photographic paper through the washing baths 5–7. Sink marks or warpage of the resin is likely to occur to cause extreme difficulty in positioning in consideration of precision of parts. Note that the sign P designates a transporting path of the photographic paper defined by means of transporting racks and submerged blade mechanisms that are not shown.

To ensure a sealed state in fitting the sealing partitions 2–4 or the washing baths 5–7, it is necessary as disclosed in JP-A 6-067393 to form secured portions in a stepped shape or tilted shape as viewed in the vertical direction. See FIGS. 13 and 14. The secured portions in such shapes are inconsistent to reducing the device size, because the width of the washing baths 5 and 6 is raised, to increase useless spaces S1 and S2. For the purpose of preventing the problem, it is conceivable as depicted in FIG. 15 to form a vertical inner surface of the washing bath 7, and to dispose the sealing mechanism 8*c* between the vertical surface and the sealing partition 4. However, the reliability of the structure according to this idea is very low. A completely sealed state between the elements is difficult to obtain. Furthermore, load to be applied to the structure at the time of drawing out and insertion is considerably high.

SUMMARY OF THE INVENTION

In view of the foregoing problems, an object of the present invention is to provide a multi-chamber washing device for photosensitive material in which a sealed state between elements of washing baths can be ensured, and in which a space for the installation can be reduced reliably.

In order to achieve the above and other objects and advantages of this invention, a multi-chamber washing device is provided, having plural washing chambers for washing photosensitive material with washing liquid by passage of the photosensitive material through a series thereof. A washing bath main vessel stores the washing liquid. A washing chamber rack assembly is set in the washing liquid in the washing bath main vessel. The washing chamber rack assembly includes plural cell units, having the washing chambers, and having an opening in an upside thereof. A cell connection portion connects upper and lower ones of the cell units together and substantially vertically, the cell connection portion having first and second connection surfaces, formed on a set of the upper and lower cell units, for closing the opening of the lower cell unit with the upper cell unit. A sealing medium is disposed at the first connection surface between the cell units by sealing the first and second connection surfaces, for keeping the cell units in a liquid-tight manner, to constitute the washing chambers individually. A blade mechanism is associated with respectively one of the upper and lower cell units connected by the cell connection portion, for allowing the photosensitive material to pass, and for blocking passage of the washing liquid. A transporting rack is secured to the cell units, for transporting the photosensitive material.

The first connection surface has an insertion groove for containing the sealing medium with one portion thereof protruded externally.

The sealing medium is in a ring shape, the second connection surface has a ridge for protruding toward the sealing medium, and is thrust into the sealing medium upon connection of the cell units, for keeping sealed by resilient deformation.

The connection surface is disposed to extend in a substantially horizontal direction, separable in the vertical direction, wherein one of the cell units has the sealing medium on one side of the connection surface.

The plural cell units have a modular structure, and are coupled with one another in a vertically overlaid manner.

Each of the cell units includes a cell lower panel. Plural cell lateral panels extend upwards in a box shape from side lines of a periphery of the cell lower panel. A passage channel is formed through the cell lower panel or the cell lateral panels. The blade mechanism is secured to the passage channel.

The plural cell units include upper and lower cell units. The cell lateral panels of the lower cell unit include an upper end surface, disposed to extend along an edge of the cell lower panel of the upper cell unit, and having the sealing medium secured thereto. The cell lower panel of the upper cell unit has the connection surface for engagement with the sealing medium frictionally.

The sealing medium includes a sealing projection disposed to project from a sealing medium upper surface toward the upper cell unit, and deformable resiliently for setting a sealed state.

The lower cell unit includes an insertion groove, formed in the upper end surface, for receiving insertion of the sealing medium.

The upper cell unit includes an auxiliary projection disposed to project from the connection surface under the cell lower panel toward the lower cell unit. The sealing medium includes an auxiliary groove, formed in a sealing medium upper surface and in an offset manner from the auxiliary projection, for rendering flexible a portion of the sealing medium upper surface for contact with the auxiliary projection.

In one preferred embodiment, the sealing medium comprises an O-ring.

In another preferred embodiment, the lower cell unit includes a retaining projection, formed to project from the upper end surface, and having the sealing medium secured thereto.

In one preferred embodiment, furthermore, a partition panel is disposed to extend in the washing bath main vessel, for grouping the plural washing chambers in upstream and downstream groups. A lower blade mechanism is incorporated in the partition panel between the upstream and downstream groups and in a lower portion thereto. The washing chamber rack assembly comprises plural washing chamber rack assemblies disposed in respectively the upstream and downstream groups.

The plural washing chambers include a lowest washing chamber positioned lowest. At least one first washing chamber has one of the cell units, and is positioned on an upper side of a portion of the lowest washing chamber. At least one second washing chamber has one of the cell units, and is positioned on the upper side of the lowest washing chamber and beside the first washing chamber substantially horizontally. The photosensitive material is transported serially through the first washing chamber, the lowest washing chamber and the second washing chamber. The lowest washing chamber has an open structure defined by an outer surface of the cell units and a surface of the partition panel.

The transporting rack comprises plural transporting racks. The plural transporting racks include at least one lower transporting rack, disposed in the lower washing chamber, for transporting the photosensitive material along a path passing through the lower washing chamber, and for supporting the plural cell units thereon.

In still another preferred embodiment, the lower cell unit comprises first and second lower cell units positioned lowest and opposite to one another with respect to the partition panel. Furthermore, a first passage channel is formed in the first lower cell unit, opposed to the lower blade mechanism, for passage of the photosensitive material. A second passage channel is formed in the second lower cell unit, opposed to the lower blade mechanism, for passage of the photosensitive material.

In one preferred embodiment, the plural washing chambers comprise first and second lowest washing chambers positioned lowest and beside one another substantially horizontally. The first lower cell unit has the first and second lowest washing chambers. Furthermore, a middle blade mechanism is incorporated in the lower cell unit, disposed between the first and second lowest washing chambers, for allowing the photosensitive material to pass, and for blocking passage of the washing liquid.

Furthermore, a lowest partition panel extends substantially vertically, and for separating the lower cell unit into the first and second lowest washing chambers. The middle blade mechanism is secured to the lowest partition panel.

In another preferred embodiment, the lower cell unit comprises first and second lower cell units positioned lowest and beside one another substantially horizontally. The blade mechanism has first and second blade mechanisms secured to respectively the first and second lower cell units, and opposed to each other.

In one preferred embodiment, the plural washing chambers include a lowest washing chamber, positioned lowest, for constituting the lower cell unit. At least one first washing chamber is disposed on an upper side of at least a portion of the lowest washing chamber. At least one second washing chamber is disposed on the upper side of the lowest washing chamber and beside the first washing chamber substantially horizontally, for constituting the upper cell unit together with the first washing chamber. The photosensitive material is transported serially through the first washing chamber, the lowest washing chamber and the second washing chamber.

The at least one upper cell unit comprises a first upper cell unit coupled with the lower cell unit on an upper side thereof. A second upper cell unit is coupled with the first cell unit on an upper side thereof.

The lower cell unit includes the lowest washing chamber, and a second lowest washing chamber disposed beside the lowest washing chamber. The first upper cell unit includes the first and second washing chambers. The second upper cell unit includes a first upper washing chamber disposed on an upper side of the first washing chamber, and a second upper washing chamber disposed beside the first upper washing chamber. The photosensitive material is transported serially through the first upper washing chamber, the first washing chamber, the lowest washing chamber, the second lowest washing chamber, the second washing chamber, and the second upper washing chamber.

In still another preferred embodiment, the plural cell units include a first cell unit positioned lowest. Second and third cell units are placed on an upper side of the first cell unit serially. A fourth cell unit is positioned lowest and beside the first cell unit substantially horizontally. Fifth and sixth cell units are placed on an upper side of the fourth cell unit serially. The photosensitive material is transported serially through the third, second, first, fourth, fifth and sixth cell units.

In accordance with one aspect of the invention, a multi-chamber washing device, having plural washing chambers for washing photosensitive material with washing liquid by passage of the photosensitive material through a series thereof, includes a washing chamber rack assembly. Plural cell units are open upwards, and coupled with one another substantially vertically by a modular structure, wherein each of the plural cell units has at least one of the plural washing chambers. A sealing medium keeps a cell connection portion between the cell units in a liquid-tight state. A blade mechanism is secured to a panel constituting the cell units, for allowing the photosensitive material to pass between adjacent ones of the washing chambers, and for blocking passage of the washing liquid. A transporting rack transports the photosensitive material in a direction serially to pass the washing chambers. The cell connection portion includes a connection surface, disposed to extend in a substantially vertical direction, separable for removal of the cell units in the vertical direction, wherein the sealing medium is secured to one of two cell units being coupled.

Each of the cell units includes a cell lower panel. Plural cell lateral panels extend upwards in a box shape from side lines of a periphery of the cell lower panel. A passage channel is formed through the cell lower panel or the cell lateral panels. The blade mechanism is secured to the passage channel.

The plural cell units include upper and lower cell units. The cell lower panel of the upper cell unit has an outward directed surface having the sealing medium secured thereto. The cell lateral panels of the lower cell unit include an upper edge portion for extending along an edge of a cell lower panel of the upper cell unit. An inward directed surface is positioned at the upper edge portion, for constituting the connection surface and for frictional engagement with the sealing medium.

The upper cell unit includes a connection inner projecting ridge formed on an inner position of the cell lower panel to project toward the lower cell unit in association with the inward directed surface. An insertion groove is formed in the outward directed surface in the connection inner projecting ridge, for receiving insertion of the sealing medium.

The sealing medium comprises an O-ring.

In one preferred embodiment, the sealing medium includes a fixed end portion retained inside the insertion groove. A free end portion is disposed to extend from the fixed end portion, and movable elastically relative to the inward directed surface.

The sealing medium is in a star shape or V shape as viewed in cross section.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
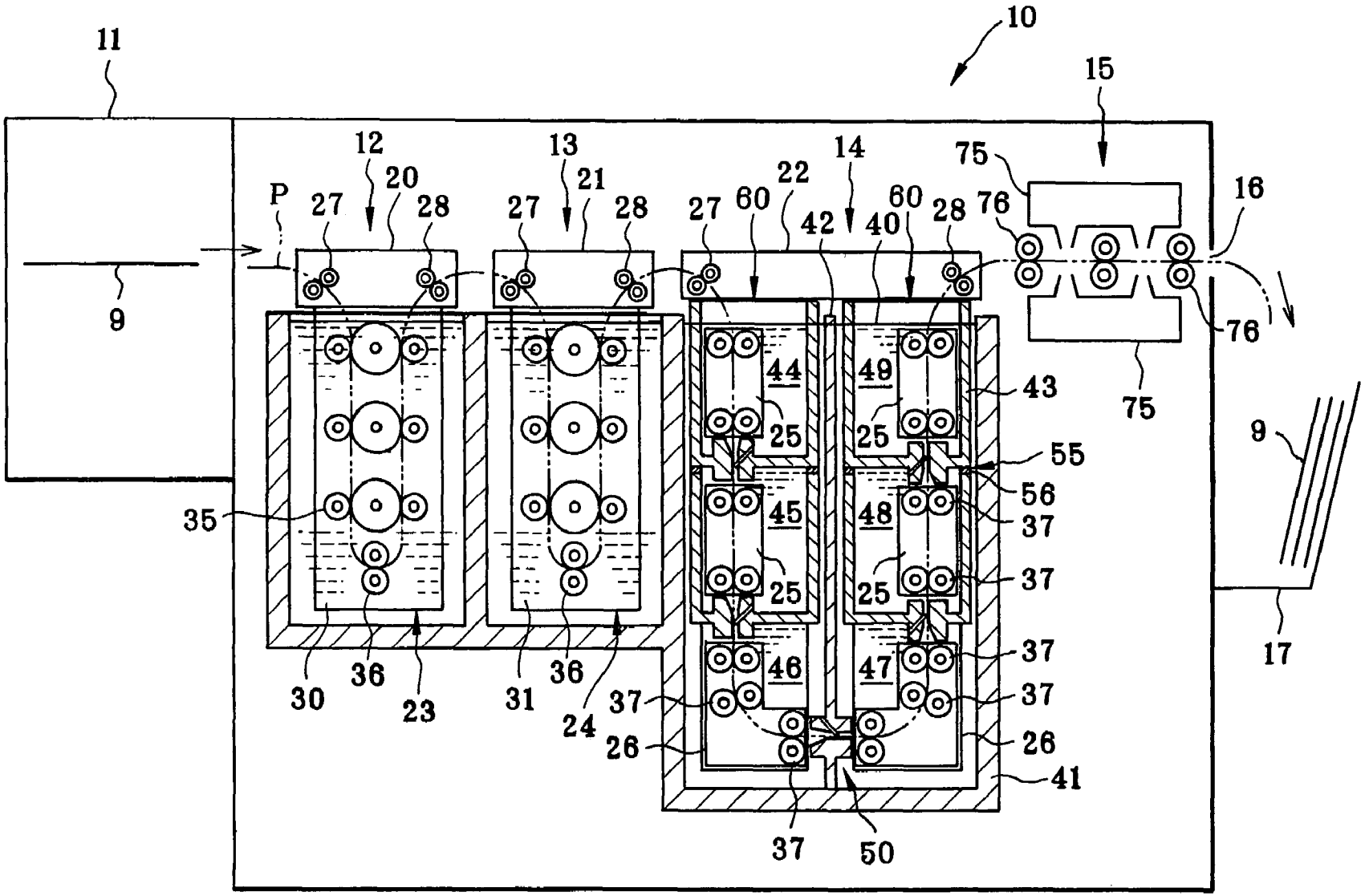
FIG. 1 is an explanatory view in section, illustrating a photographic paper processor.

In FIG. 1, a photographic paper processor 10 as photosensitive material processor of the invention is illustrated. A paper delivery device 11 is disposed at an upstream end of the paper processor 10, and delivers exposed color photographic paper 9 as photosensitive material into the paper processor 10. The paper processor 10 has a series of vessels for a color developing bath 12, a bleach/fixing bath 13, a multi-chamber washing device as washing bath 14, and a drier 15. The color developing bath 12 stores color developing solution. The bleach/fixing bath 13 stores bleach/fixing solution. The multi-chamber washing device 14 stores washing liquid or water. The drier 15 blows hot gas to the photographic paper 9 for drying. A dispensing slot 16 is formed at a downstream end of the drier 15 for exiting the photographic paper 9 after drying. A print stacker 17 is also associated with the dispensing slot 16, for receiving and stacking the photographic paper 9 from the dispensing slot 16. In the embodiment, the photographic paper 9 is cut into sheets by each of the images, the sheets being sent to the color developing bath 12. Note that it is possible in place of the paper delivery device 11 to install a printing component, in which a photographic paper roll is set, the photographic paper 9 is unwound and cut into sheets, which are exposed for printing images. The color developing bath 12 is supplied with the exposed sheets by the printing component. Furthermore, the photographic paper 9 may be a photographic paper strip longer than each sheet to be transported inside the paper processor 10. For this situation, the paper strip is cut by a cutter into plural sheets on borderlines between image frames. Upon the cutting operation, the sheets exit from the dispensing slot 16 toward the print stacker 17.

Crossover racks 20, 21 and 22 are disposed on the top of respectively the liquid baths 12, 13 and 14. Transporting racks 23, 24, 25 and 26 are incorporated suitably in the liquid baths 12–14. Each of the crossover racks 20–22 has two transporting roller sets 27 and 28. The transporting roller set 27 transports the photographic paper 9. The transporting roller set 28 transports the photographic paper 9, and also removes liquid from the surface of the photographic paper 9 by squeezing, so as to prevent the processing solution from being moved to succeeding baths together with the photographic paper 9. The transporting roller sets 27 and 28 cause the photographic paper 9 to enter the liquid baths 12–14, and also send the photographic paper 9 from one of the liquid baths 12–14 toward a succeeding one of the bleach/fixing bath 13, the multi-chamber washing device 14 and the drier 15. It is to be noted that a squeezing mechanism may be additionally used in a manner separate from the transporting roller set 28.

The transporting racks 23–26 transport the photographic paper 9 through the liquid baths 12–14 in a submerged state. Transporting rack bodies 30, 31, 32 and 33 are parts of the transporting racks 23–26, and contain plural transporting roller sets 35, 36 and 37. In the crossover racks 20–22 and the transporting racks 23–26, motors (not shown) are used to rotate the transporting roller sets 27 and 28 and 35–37.

Figure 2:
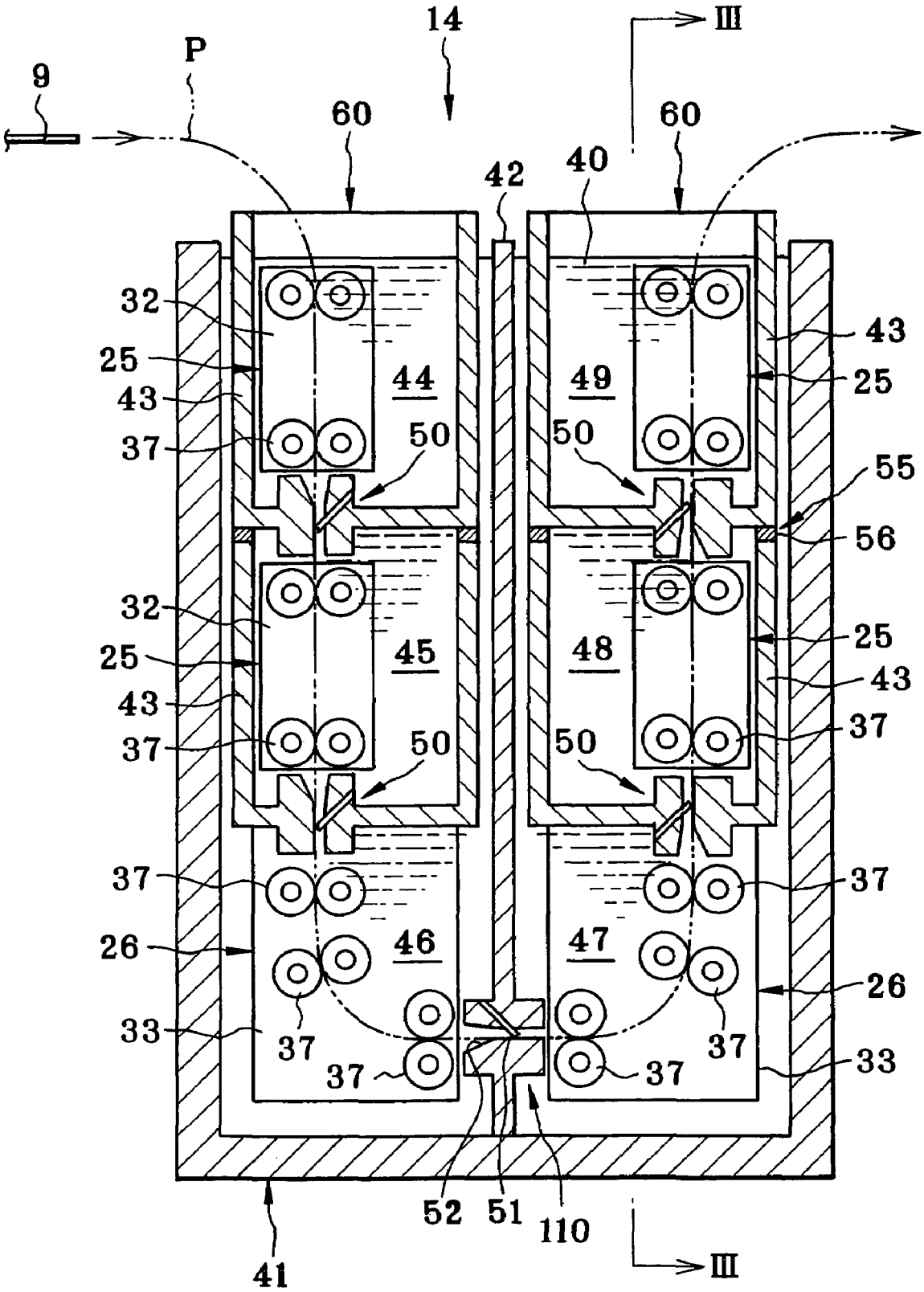
FIG. 2 is a vertical section illustrating a multi-chamber washing device.
Figure 3:
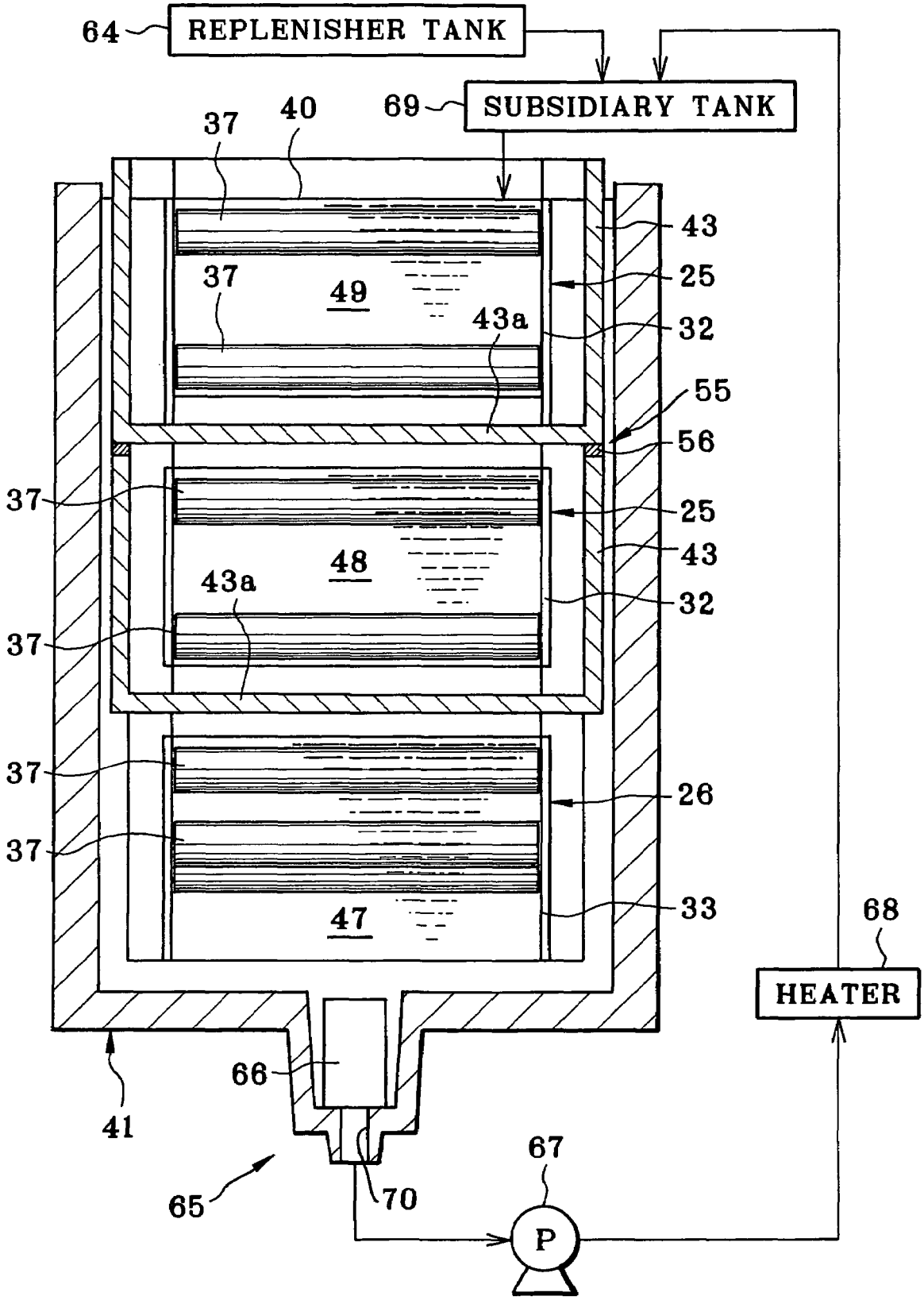
FIG. 3 is a vertical section taken on line III—III, illustrating the multi-chamber washing device.

In FIGS. 2 and 3, the multi-chamber washing device 14 according to the embodiment is illustrated, and includes a washing bath main vessel 41, a partition panel 42, modular vessels or cell units 43, and the transporting racks 25 and 26. The washing bath main vessel 41 stores washing water 40 as washing liquid. The partition panel 42 extends vertically at the middle of the washing bath main vessel 41, for separation of the washing bath main vessel 41 into two zones. The cell units 43 are installed in the two zones beside the partition panel 42, and split the zones into three chambers as viewed in the vertical direction. There are six washing chambers 44–49, which are compartments defined by the partition panel 42 and the cell units 43. Among them, lowest washing chambers 46 and 47 are positioned the lowest. The transporting racks 25 and 26 transport the photographic paper 9 through the washing chambers 44–49. The photographic paper 9 is moved in the order from the washing chamber 44 to the washing chamber 49. A preferred example of the washing water is deionized water with bactericidal tablet mixed therewith. However, other washing liquid may be used, for example rinsing solution.

Figure 4A:
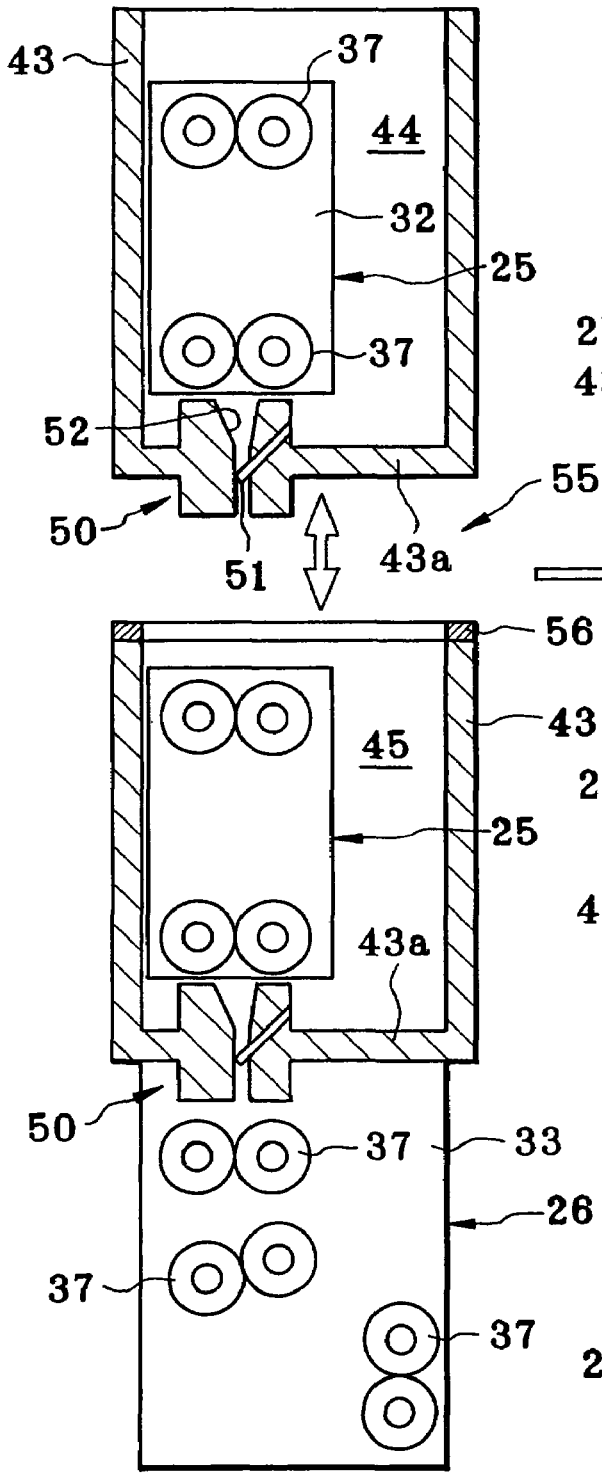
FIG. 4A is an explanatory view illustrating a disassembled state of the cell units.
Figure 4B:
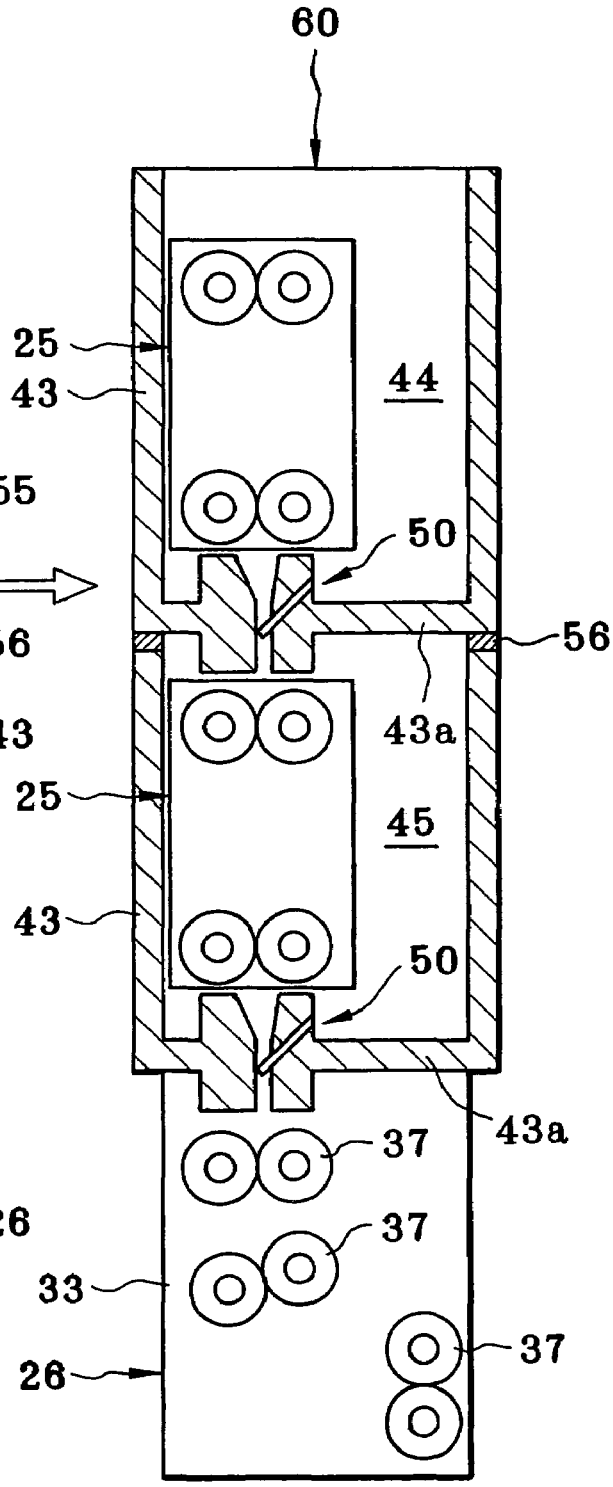
FIG. 4B is an explanatory view illustrating an assembled state of the same as FIG. 4A.

In FIGS. 4A and 4B, each of the cell units 43 has generally a rectangular parallelepipedic shape, and is open in the upward direction A cell lower panel 43*a* of the cell unit 43 has a submerged squeezing blade mechanism 50, which allows the photographic paper 9 to pass, and blocks the washing water 40 from flowing through. In FIG. 2, a lower side of the partition panel 42 has a lower submerged squeezing blade mechanism 110 similarly. An elastic blade 51 of resin or metal is included in the blade mechanism 50 for opening and closing. Examples of materials to produce the blade 51 include elastomers having resistance to chemical material, such as heat hardening polyurethane, silicone rubber, and the like, and include metals, such as stainless steel, titanium, and nickel-base alloy, for example Hastelloy (trade name), Inconel (trade name) and the like. A passage channel 52 comes through the blade mechanism 50 at the blade 51, which is secured to the cell units 43 or the partition panel 42 and tilted with reference to the surface of the passage channel 52. An end of the blade 51 is kept in contact with the surface of the passage channel 52 by resiliency. This contact closes the passage channel 52 in the liquid-tight manner, to block passage of the washing water 40. However, in passage of the photographic paper 9, the blade 51 is pushed open resiliently, to allow passage of the photographic paper 9 between the surface of the passage channel 52 and the end of the blade 51. Note that two blades may be included in the blade mechanism 50 instead of the blade 51 being single. With the two blades, their ends are contacted by each other with resiliency, in order to allow passage of the photographic paper 9 and block passage of the washing water 40.

The transporting rack 25 is installed inside the cell units 43. The transporting rack 25 includes the transporting rack body 32, and the transporting roller sets 37 supported in a rotatable manner. Each of the transporting roller sets 37 are caused to rotate by a drive shaft (not shown). The drive shaft extends vertically and comes through each of the cell units 43. There is a rotational sealing member attached to an edge of each of the axial holes in the cell units 43 for the drive shaft.

The transporting rack 26 is disposed under two of the cell units 43 for constituting the washing chambers 45 and 48. The transporting rack 26 includes the transporting rack body 33 and three of the transporting roller sets 37 rotatably mounted. The transporting roller sets 37 change over the transporting path P from the vertical direction to the horizontal direction by a rotational change of 90 degrees.

In FIG. 2, the cell units 43 and the transporting racks 25 and 26 are positioned and secured in a symmetrical form with reference to the partition panel 42. Thus, the feeding path P of the photographic paper 9 is in the U-shaped in the washing bath main vessel 41.

In FIGS. 4A and 4B, cell connection portions 55 are included in the cell units 43 and oriented for connection to extend in the vertical direction. Elastic sealing mediums 56 keep the inside of the washing chambers 45 and 48 shielded from liquid in the cell units 43. Examples of material of the sealing mediums 56 include silicone rubber, fluororubber, nitrile rubber, hydrogenated nitrile rubber, ethylene/propylene rubber, olefin elastomer, hydrogenated styrene elastomer, and the like.

Figure 5A:
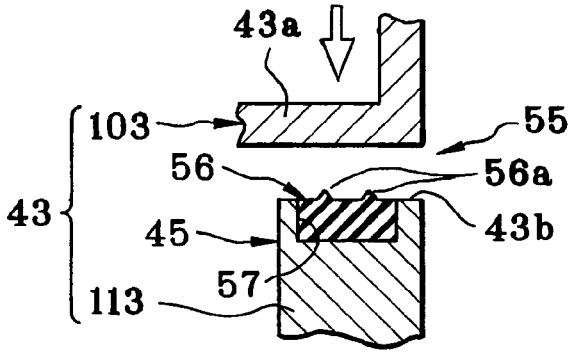
FIG. 5A is a cross section, partially broken, illustrating two adjacent cell units and an elastic sealing medium.

In FIG. 5A, an insertion groove 57 is formed in the cell connection portions 55 in an upper end connection surface 43*b* of a cell lateral panel of a lower cell unit 113 among the cell units 43. Two sealing ridges 56*a* project from each of the elastic sealing mediums 56. The sealing medium 56 is fitted in the insertion groove 57. The sealing ridges 56*a* are deformed by the weight of an upper cell unit 103 among the cell units 43 with the gravity when the cell units 43 are coupled on the upper and lower sides. The sealing ridges 56*a* keep the cell units 43 shielded in a liquid-tight manner as a combination of the upper and lower cell units 103 and 113 included in the cell units 43.

Note that the second uppermost one of the cell units 43 and the transporting rack 26 are correlated by supporting of the cell units 43 on the frame of the transporting rack 26. See FIGS. 4A and 4B. However, it is possible in place of this structure to use a suitable element for keeping the second uppermost one of the cell units 43 at the same level of the embodiment.

Connection mechanisms (not shown) are used for interconnecting the cell units 43 and the transporting racks 25 and 26. So a washing chamber rack assembly 60 in a multi-chamber washing device is obtained as a composite device in combination of the various elements. See FIGS.

4A and 4B. The connection mechanisms include screws, hooks, projection, and the like for retention. Also, there is an air release drain mechanism (not shown) disposed in the washing chambers 44–46 and 47–49 for introducing or ejecting the washing water 40. The air release drain mechanism includes an operation rod and a valve. The operation rod extends to come through the washing chambers 44–46 and 47–49. The valve is connected between the operation rod and a lower portion of each of the cell units 43. The valve is opened by operating the operation rod for loading or unloading of the rack assembly 60 at the washing bath main vessel 41. The valve is used at the loading time for removing air and introducing washing water, so as to fill the washing chambers 44–46 and 47–49 with washing water. To draw the rack assembly 60 away from the washing bath main vessel 41, washing water is ejected through the valve. When the drawing is completed, no washing water remains in the washing chambers 44, 45, 48 and 49. The rack assembly 60 can be raised in the state after the elimination of the water. This facilitates the removal of the rack assembly 60 because of the reduced weight.

An anti-backflow valve (not shown) are connected between the washing chambers 44–49. In FIG. 2, the washing water 40 is caused to flow in the direction from the washing chamber 49 toward the washing chamber 44. A flow in an opposite direction from the washing chamber 44 toward the washing chamber 49 is blocked. In FIG. 3, there are a replenisher tank 64 and a subsidiary tank 69 through which unused washing water is added to the washing chamber 49, and then is poured into the washing chambers 48–44. The washing water overflown in the washing chamber 44 is ejected and drained to a waste liquid tank. As described herein, the cascade structure combined with an anti-backflow valve is used.

A water circulating system for the washing chambers 47–49 is separate from a water circulating system for the washing chambers 44–46 that are grouped by the partition panel 42. In FIG. 3, a water circulator 65 for the washing chambers 47–49 is illustrated, and includes a filter 66, a pump 67, a heater 68 and the subsidiary tank 69. The subsidiary tank 69 is disposed beside the washing bath main vessel 41. A drain 70 is disposed under the washing chambers 47–49, associated with the washing bath main vessel 41, has the filter 66, and is connected with the pump 67. The washing water is sucked through the drain 70 for discharge, and is sent to the subsidiary tank 69 via the heater 68. There are a temperature sensor and a liquid level sensor (not shown) incorporated in the subsidiary tank 69. Outputs of those sensors are sent to the controller. The controller controls various elements of the paper processor 10 in a centralized manner, and also controls the heater 68 for keeping the washing water 40 in a predetermined range of the temperature. In addition, the controller causes replenishment of unused washing water at a predetermined amount from the replenisher tank 64 according to a processed amount of the photographic paper 9.

In FIG. 1, a duct 75 is one of the elements of the drier 15 having a heater (not shown), fan and the like. Plural transporting rollers 76 transport the photographic paper 9 while the drier 15 dries the photographic paper 9. When the photographic paper 9 is dried, the photographic paper 9 exits from the dispensing slot 16 and becomes transferred to the print stacker 17 for being stacked. Note that a known mechanism of a sorter may be used in place of the print stacker 17. The sorter can be used for sorting and stacking the prints per each one of customer orders.

The operation of the embodiment is described. In FIG. 1, the photographic paper 9 is delivered from the paper delivery device 11 to the photographic paper processor 10, where the crossover rack 20 and the transporting rack 23 transport the photographic paper 9 through the color developing bath 12 for photographic development. Similarly, the photographic paper 9 is transported past the bleach/fixing bath 13 for bleaching and fixing. The photographic paper 9 is caused by the crossover rack 22 and the washing chamber rack assemblies 60 to move past the washing chambers 44–49 in the washing bath main vessel 41, and is washed by the washing water. Note that in the washing process, the washing chamber 49 is supplied with unused washing water by replenishment, and caused to flow into the washing chambers 48, 47, 46, 45 and 44 in series as compartments. The photographic paper 9 being washed is sent to the drier 15 and dried with hot air, and is ejected into the print stacker 17.

To inspect the multi-chamber washing device 14 or eliminate jamming from the photographic paper 9, any one of the washing chamber rack assemblies 60 is taken out of the washing bath main vessel 41. A manual operable rod (not shown) is turned to open the valve. Then the rack assembly 60 is raised upwards. The opening movement of the valve and the rise cause the washing water to exit from the washing chambers 44–49. Then the rack assembly 60 is set into the washing bath main vessel 41 again. Then each of the cell units 43 is disassembled. The transporting rack 25 or 26 may be removed from the cell units 43, to enable inspection or elimination of paper jam. After the maintenance, the operable rod is turned to open the valve. The rack assembly 60 is set back into the washing bath main vessel 41 by slow movement. The valve is subjected to air removal. Also, the valve supplies the washing water 40 into the washing chambers 44–49. After the air is exited completely from the washing chambers 44–49, the valve is closed. Then the processing operation restarts.

In the embodiment, the partition panel 42 is used to split the washing bath main vessel 41 into the two regions. Then the washing chamber rack assemblies 60 are inserted to define the washing chambers 44–49. Other structures as illustrated in FIGS. 6–12 may be used for constituting a washing chamber rack assembly.

Figure 6:
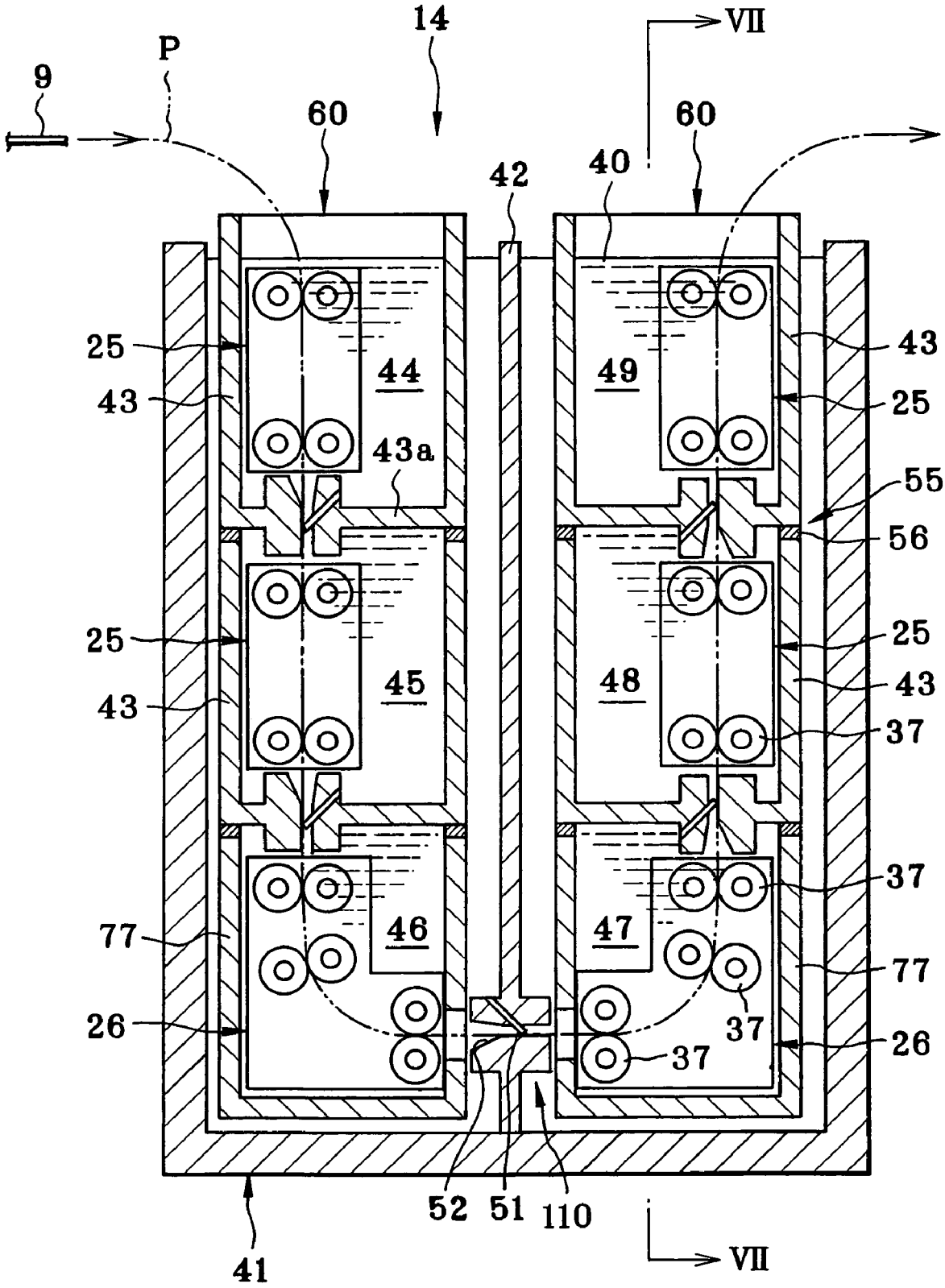
FIG. 6 is a vertical section illustrating one preferred multi-chamber washing device having a partition panel.
Figure 7:
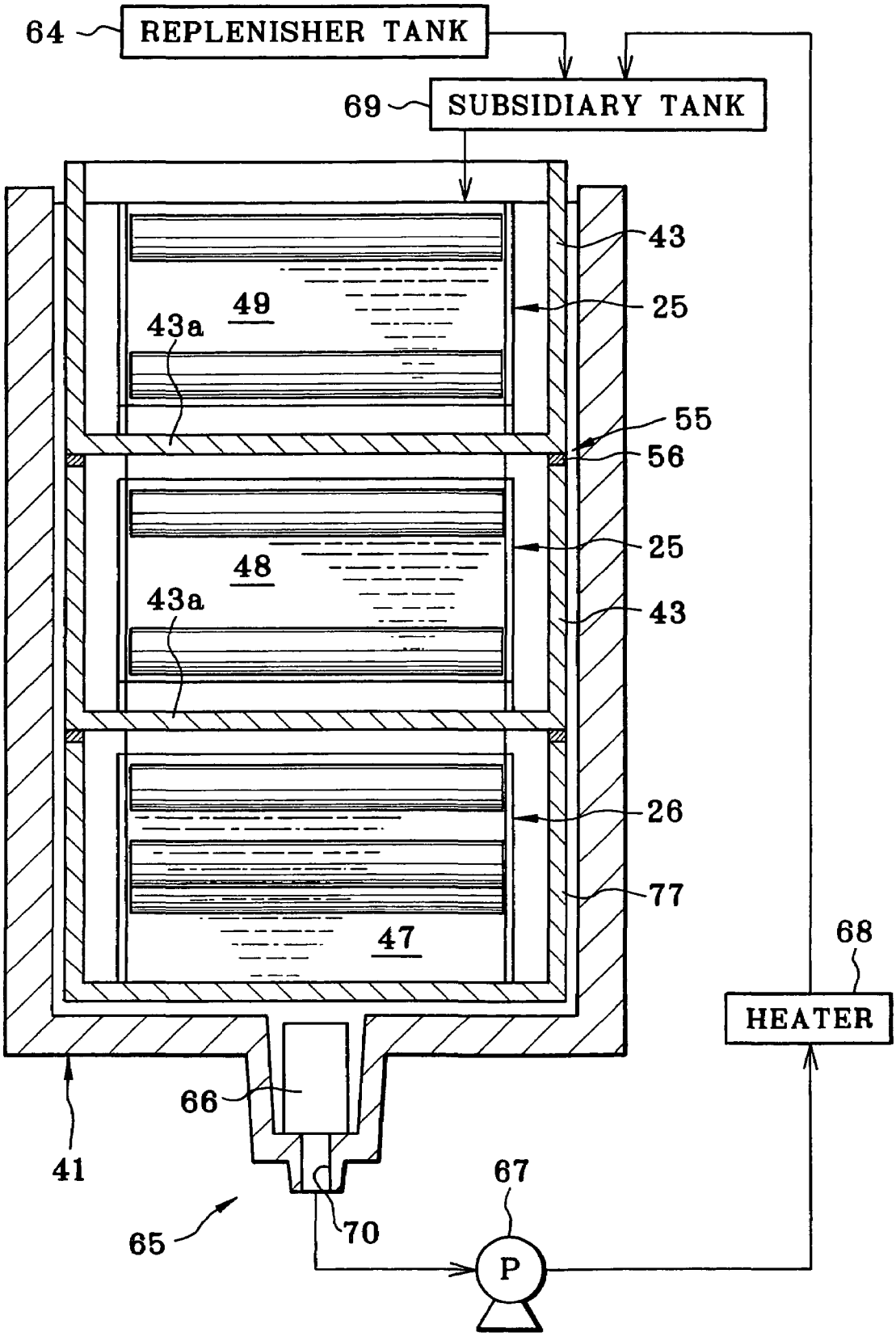
FIG. 7 is a vertical section taken on line VII—VII, illustrating the multi-chamber washing device.
Figure 8:
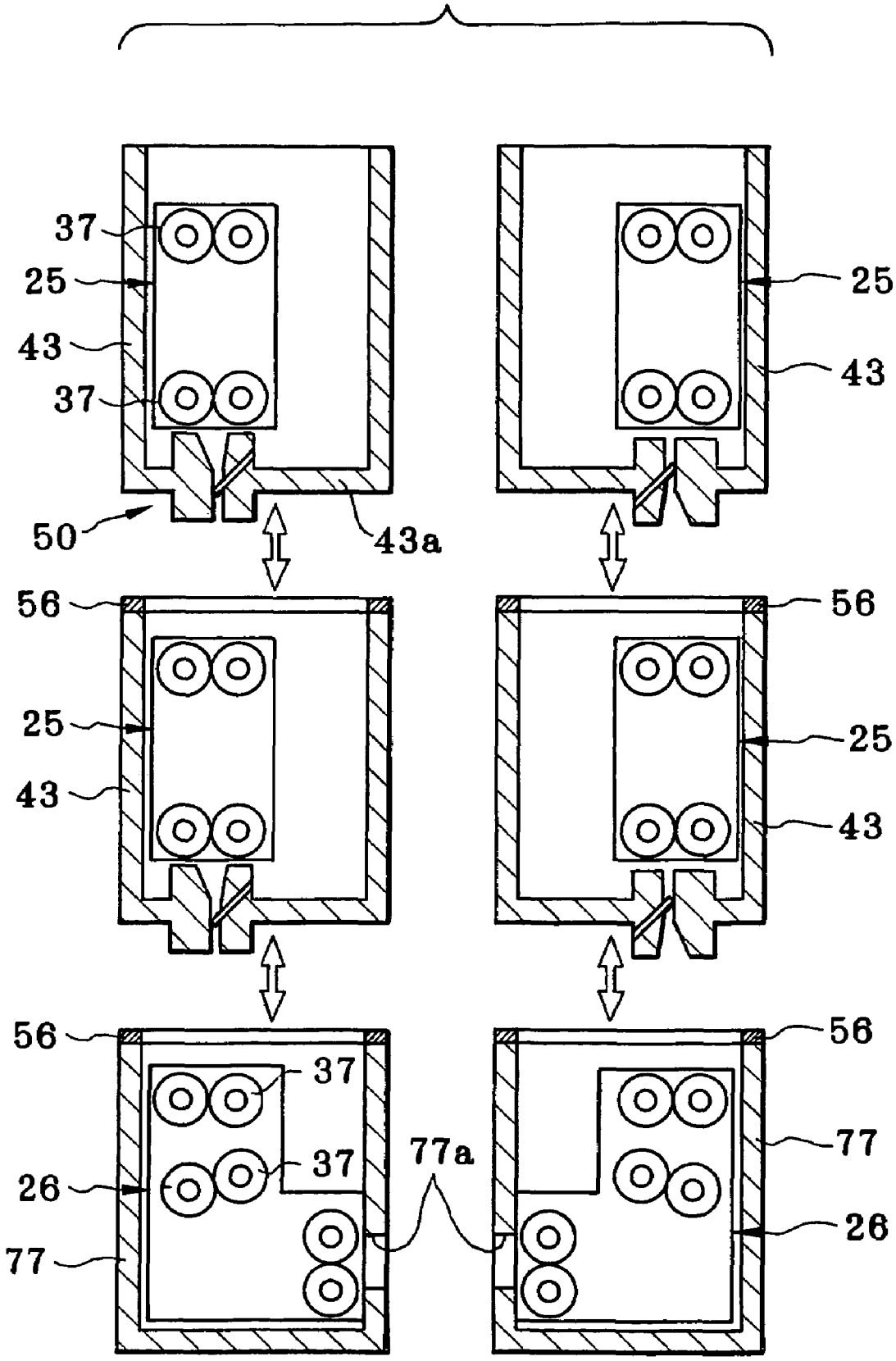
FIG. 8 is an explanatory view in section, illustrating a disassembled state of the cell units.

In FIGS. 6, 7 and 8, one preferred embodiment of the invention is illustrated. A modular vessel or cell unit 77 is used in a form unlike the lowest washing chambers 46 and 47 of the above, and is connected in a vertical direction to constitute the lowest washing chambers 46 and 47. A passage channel 77*a* is formed in the cell unit 77 for transferring the photographic paper 9 to the washing chamber 47. In contrast with the above embodiment where the partition panel 42 simply separates the washing chamber 47 from the washing chamber 46, each of the lowest washing chambers 46 and 47 in the embodiment can be kept more reliably liquid-tight. This can raise the efficiency in water washing. Note that elements similar to those of the above embodiment are designated with identical reference numerals. This will apply in any of preferred embodiments hereinafter referred to.

In any of the two embodiments described heretofore, the washing bath main vessel 41 is separated into the two regions. The water circulators 65 are associated with respectively the two regions with the washing chambers 44–46 and 47–49. See FIG. 3. This is advantageous in keeping high the efficiency of circulation of the washing water.

Figure 9:
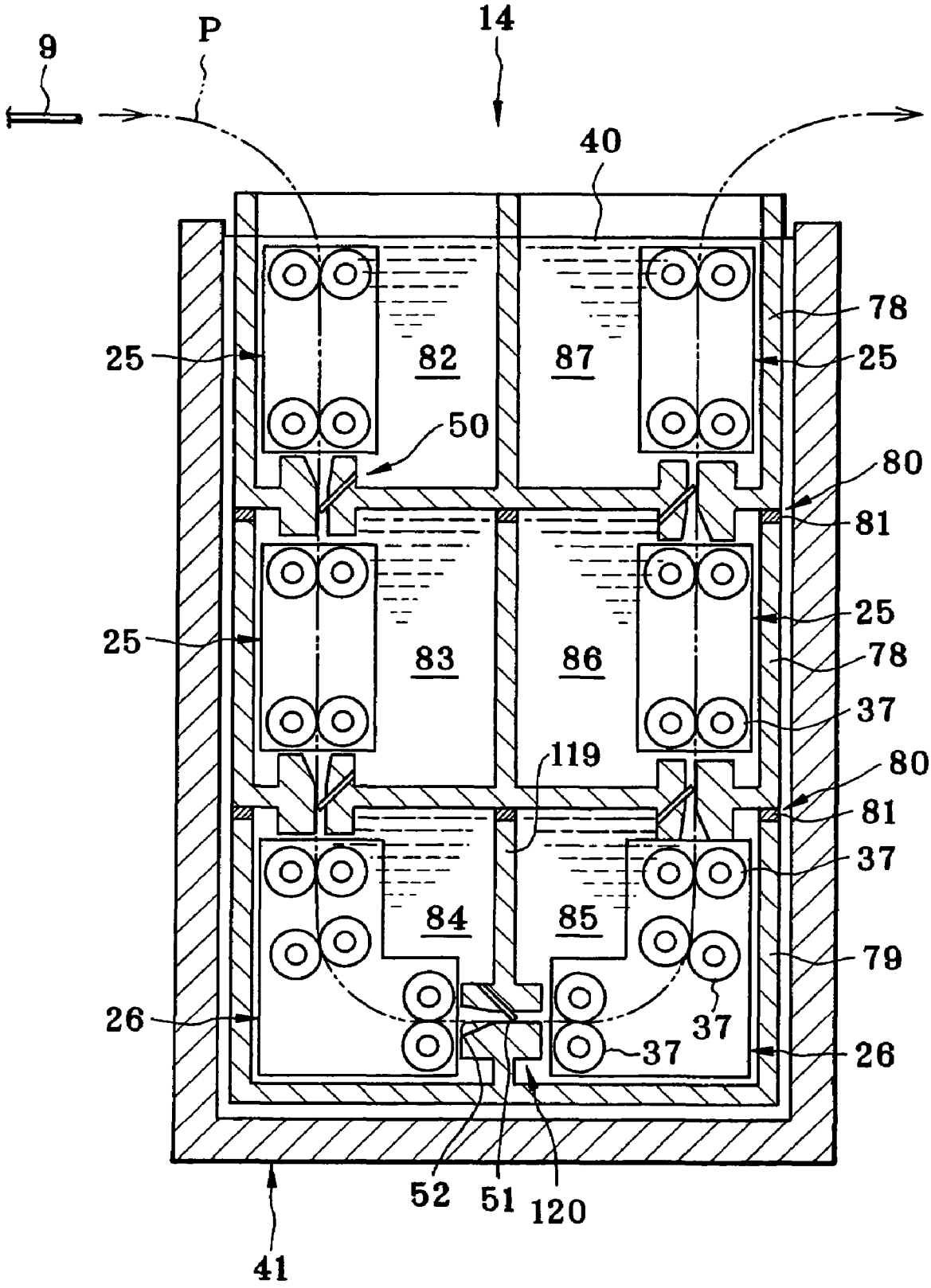
FIG. 9 is a vertical section illustrating still another preferred multi-chamber washing device.
Figure 10:
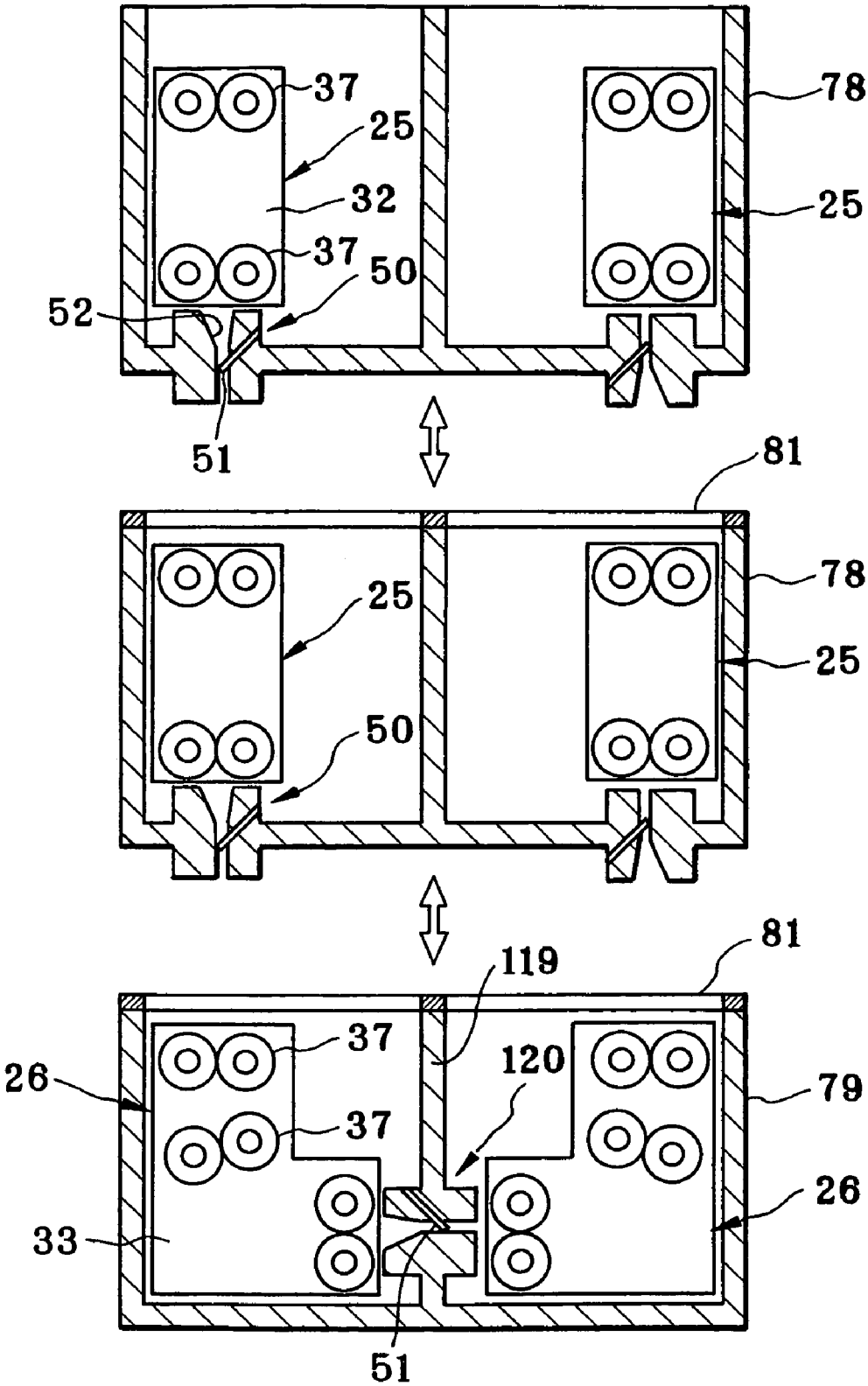
FIG. 10 is an explanatory view in section, illustrating a disassembled state of the cell units.

In FIGS. 9 and 10, still another preferred embodiment is illustrated, and has three modular vessels or cell units, which include upper cell units 78 and a lowest cell unit 79. Each of the cell units 78 and 79 has two washing chambers. Thus, washing chambers 82, 83, 84, 85, 86 and 87 are defined inside the washing bath main vessel 41. Again, elastic sealing mediums 81 are attached to cell connection portions 80 of the cell units 78 and 79, to keep the washing chambers 82–87 liquid-tight. It is possible that each one of the sealing mediums 81 may have a ring shape, and may be attached to the washing chambers 82–87. Also, the sealing mediums 81 may have an 8 shape or two-ring shape for being fitted on the edge of the openings of the two washing chambers. Note that the blade mechanism 50 and a middle submerged squeezing blade mechanism 120 is incorporated in a lower portion of the upper cell units 78, and a lower portion of a lowest partition panel 119 of the lowest cell unit 79.

Figure 11:
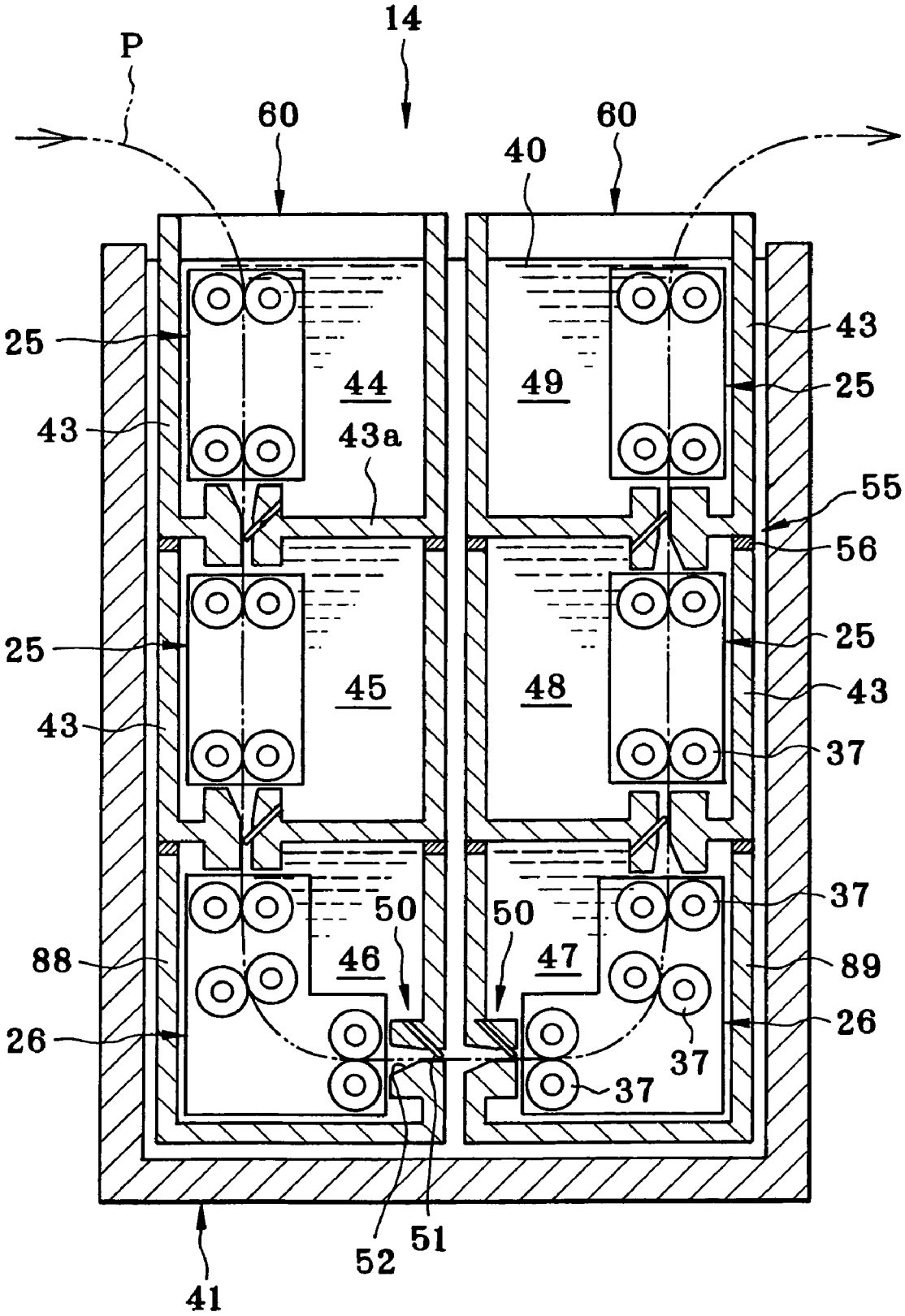
FIG. 11 is a vertical section illustrating a further preferred multi-chamber washing device.
Figure 12:
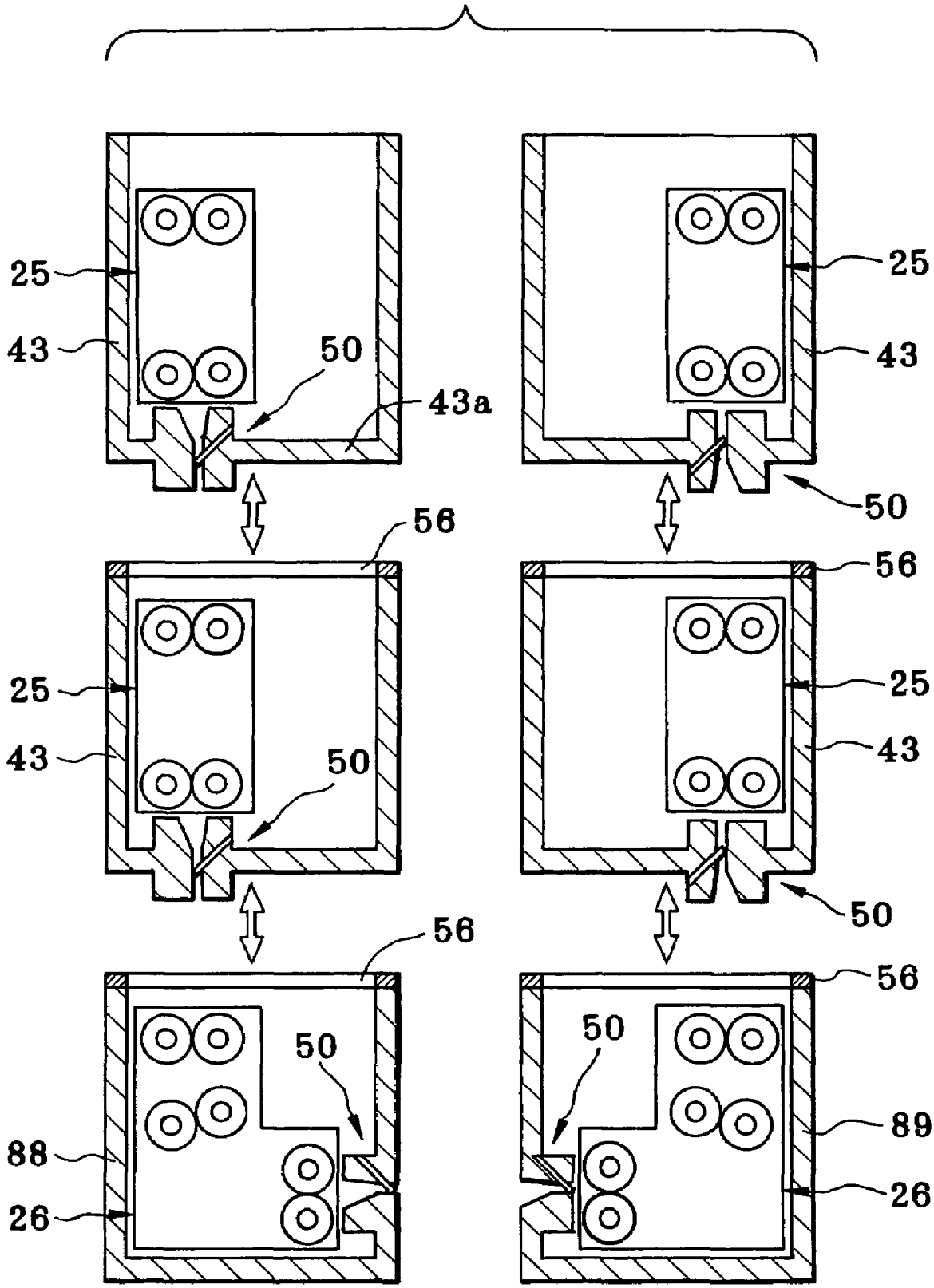
FIG. 12 is an explanatory view in section, illustrating a disassembled state of the cell units.

One additional preferred embodiment is illustrated in FIGS. 11 and 12. The structure of FIGS. 6–8 is repeated with a difference of the lack of the partition panel 42 described above. The present embodiment has two lowest modular vessels or lowest cell units 88 and 89, which has a lateral panel provided with the blade mechanism 50. The water circulator 65 is single for the washing chambers because of no use of the partition panel 42. The single structure of the water circulator 65 simplifies the general construction of the washing device.

In the above embodiment, the washing chambers are the six arranged in three vertical layers and two horizontal groups. It is, however, possible in the invention for a multi-chamber washing device as washing bath to have (m×n) washing chambers arranged in m vertical layers and n horizontal groups, where m and n are an integer of at least two. It is preferable that n is an even number. The supply and ejection of the photographic paper 9 with respect to the washing bath main vessel 41 can be effected on a commonly upper side, to simplify the mechanical structure.

Sealing structures for use in the cell connection portions 55 and 80 are now described. In the above embodiment, the elastic sealing mediums 56 and 81 having the shape as depicted in FIG. 5A are used for disposing the sealing medium on the horizontal surface on the juncture between the cell units 43. However, sealing mediums in various forms of FIGS. 5B–5G can be used for sealing the juncture between the cell units 43 and the cell units 77–79 in the liquid-tight manner, including sealing mediums 90 and 91, sealing O-rings 92 and 93, and sealing mediums 94 and 95. Note that in the description hereafter, the washing chamber 45 is used as an example in FIGS. 5A–5G.

In FIG. 5A, the cell connection portions 55 between the upper and lower cell units 103 and 113 included in the cell units 43 have an upper surface being plane, and a lower surface provided with the insertion groove 57 for containing the elastic sealing medium 56. One surface of the sealing medium 56 to contact the upper cell unit 103 among the cell units 43 is provided with the sealing ridges 56*a*, which extends for the entire circumference and has a triangular shape as viewed in cross section. The number of the sealing ridges 56*a* can be determined in any suitable manner. When the number of the sealing ridges 56*a* is high, the sealed state can be more reliable, but the securing load of the cell units 43 is also higher. When the number of the sealing ridges 56*a* is low, the securing load of the cell units 43 can be low, but the sealed state is less reliable. The sealing ridges 56*a* protrude out of the inner space of the insertion groove 57 while each of the sealing mediums 56 is fitted in the insertion groove 57. The upper and lower cell units 103 and 113 are joined together in a secured state, to create collapsing of the sealing ridges 56*a* and partial collapsing of the sealing medium 56. Thus, load of compression with elasticity occurs, to create load of surface pressure for the purpose of sealing with reaction of the load of compression. A dimension of the insertion groove 57 on the lower cell unit 113 is predetermined greater than the dimension of the sealing medium 56 in the non-load state, because of expecting clearance for elastic deformation of the sealing medium 56. A collapsing amount is equal to or less than 30%, the collapsing amount being defined as (H1−H2)/H1 where H1 is a height of the sealing medium 56 in the free state, and H2 is a height of the sealing medium 56 in the secured state. Note that a height in the free state means a height of the sealing medium 56 without application of load. If the collapsing amount becomes more than 30%, crack due to stress is likely to occur.

Figure 5E:
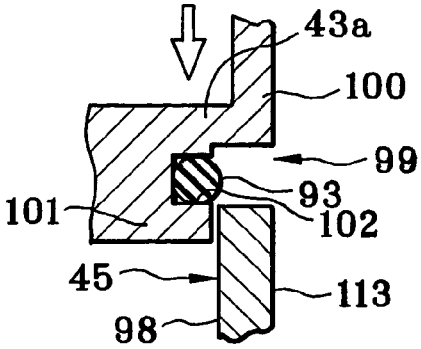
FIG. 5E–5G are cross sections, partially broken, illustrating still other preferred elastic sealing mediums of which connection surfaces extend vertical.
Figure 5B:
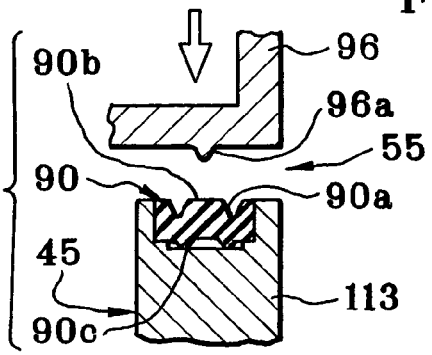
FIG. 5B–5D are cross sections, partially broken, illustrating other preferred elastic sealing mediums.

In FIG. 5B, an example is illustrated, in which the securing load can be rather low in comparison with that according to FIG. 5A, so as to obtain sufficient predetermined pressure of load. In FIG. 5A, the operation is according to the pressing load only by resilient deformation of the sealing mediums. In FIG. 5B, operation is according to the resilient deformation of the sealing mediums and structural changes of the shapes. The elastic sealing medium 90 is compressed and deformed resiliently, for obtaining load of predetermined surface pressure. Two auxiliary grooves 90*a* are formed in the sealing medium 90, extend by following the contour of the sealing medium 90, and are triangular as viewed in cross section. An upper surface 90*b* of the sealing medium 90 is located between the auxiliary grooves 90*a*. An auxiliary projection or ridge 96*a* projects from a lower portion of an upper modular vessel or upper cell unit 96, and has a triangular shape as viewed in cross section. This pressure deforms the upper surface 90*b* in the downward direction, so that pressing load occurs in the upward and downward directions due to the deformation. Accordingly, the sealing property can be reliable.

Two auxiliary ridges 90*c* project from the lower face of the elastic sealing medium 90, and extend on the whole circumference, to cause the sealing medium 90 to contact a lower face of the groove in the lower cell unit 113 among the cell units 43. The auxiliary ridges 90*c* enable easy and reliable deformation of the sealing medium 90. The washing chamber 45 is sealed by this contact of the auxiliary ridge 96*a* of the upper cell unit 96 and the upper surface 90*b* of the sealing medium 90, and by the contact of the auxiliary ridges 90*c* of the sealing medium 90 and the lower face of the lower cell groove. Also, the sealing medium 90 is pressed by the upper cell unit 96 downwards, to become deformed in the inward direction with respect to the auxiliary ridges 90*c* as fulcrum. There occurs no load of forcibly pressing to the side faces of the grooves. This facilitates the securing operation a comparatively reduced load. The auxiliary grooves 90*a* in the sealing medium 90, and also the auxiliary ridges 90*c* may be positioned in any suitable manner without symmetrical disposition. Furthermore, the shape of the auxiliary ridges 90*c* and 96*a* as viewed in cross section may be not triangular, but can be any suitable shape, for example, shape of a semi-circle, semi-ellipse, and the like. Note that the collapsing amount is determined equal to or smaller than 30%. The ridge height in the state with the collapsing amount in this range is determined as a difference by subtraction of the height of the auxiliary ridge 96*a* from the depth of the insertion groove. If the amount is greater than 30%, damages are likely to occur, such as a crack in the sealing medium 90 due to stress.

Figure 5F:
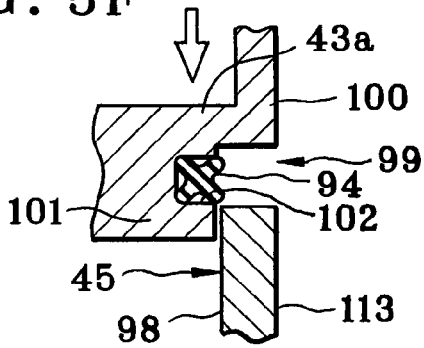
Figure 5C:
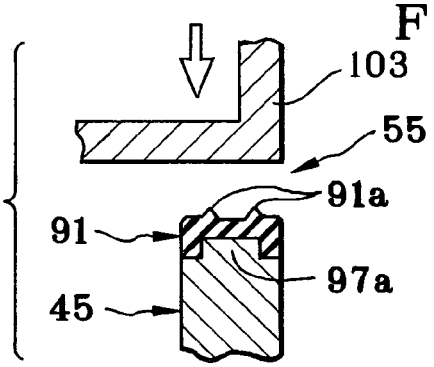

In FIG. 5C, one preferred elastic sealing medium 91 is illustrated. In place of the sealing medium 56 or 90 fittable in the insertion groove 57 as depicted in FIGS. 5A and 5B, the sealing medium 91 has a U shape as viewed in the cross section. A lower modular vessel or lower cell unit 97 has a retaining projection 97*a* at a connection surface, which is wrapped by the sealing medium 91. Note that two sealing ridges 91*a* are formed on the sealing medium 91 to extend by following the shape of the sealing medium 91, which is similar to the structure of FIG. 5A. The upper cell unit 103 among the cell units 43 is connected with the lower cell unit 97, to collapse the sealing mediums 81 and the sealing ridges 91*a* at a predetermined amount. In a manner similar to that of FIG. 5A, load of compression with elasticity occurs, to create load of surface pressure for the purpose of sealing with reaction of the load of compression. Note that the number of the sealing ridges 91*a* is two. However, the number and shape of the sealing ridges 91*a* are not limited. The collapsing amount according to the embodiment with the sealing medium 91 is set equal to or smaller than 30%.

Figure 5G:
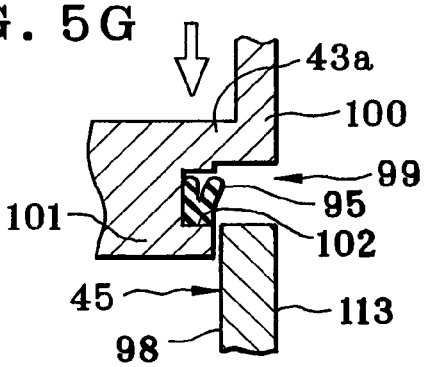
Figure 5D:
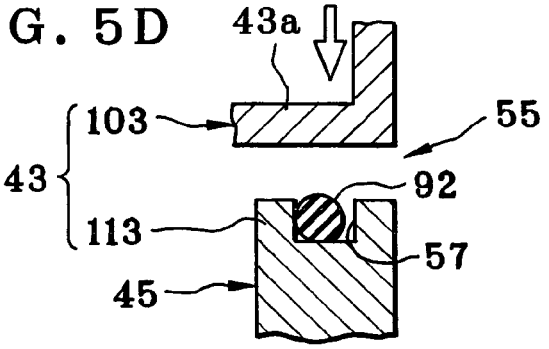

In FIG. 5D, the elastic sealing O-ring 92 is combined with the insertion groove 57 formed in an upper surface of the lower cell unit 113 among the cell units 43. The sealing O-ring 92 has a well-known circular shape as viewed in the cross section, and fitted in the insertion groove 57. The collapsing amount according to the embodiment with the sealing O-ring 92 is set equal to or smaller than 30%. Note that an elastic sealing medium may have a shape other than the circular shape as viewed in the cross section, for example X-shape.

In FIGS. 5E, 5F and 5G, other preferred cell connection portions 99 are illustrated, where a sealing surface 98 as a connection surface directed inwards is formed to extend in the vertical direction. An upper modular vessel or upper cell unit 100 is provided with an inner projecting ridge 101. An insertion groove 102 is formed in the inner projecting ridge 101 as a connection surface. The insertion groove 102 is connected with a preferred sealing medium for keeping the washing chamber 45 shielded from liquid. Examples of such preferred sealing mediums include the elastic sealing O-ring 93 of FIG. 5E, the elastic sealing medium 94 of FIG. 5F with an X-shaped section, and the elastic sealing medium 95 of FIG. 5G with a V or Y-shaped section. The collapsing amount according to FIGS. 5E and 5F is set equal to or smaller than 30%. Note that the sealing mediums 56 and 90–95 may be secured to one of the cell units opposite to that having the sealing mediums 56 and 90–95 secured thereto according to FIGS. 5A–5G.

Figure 13:
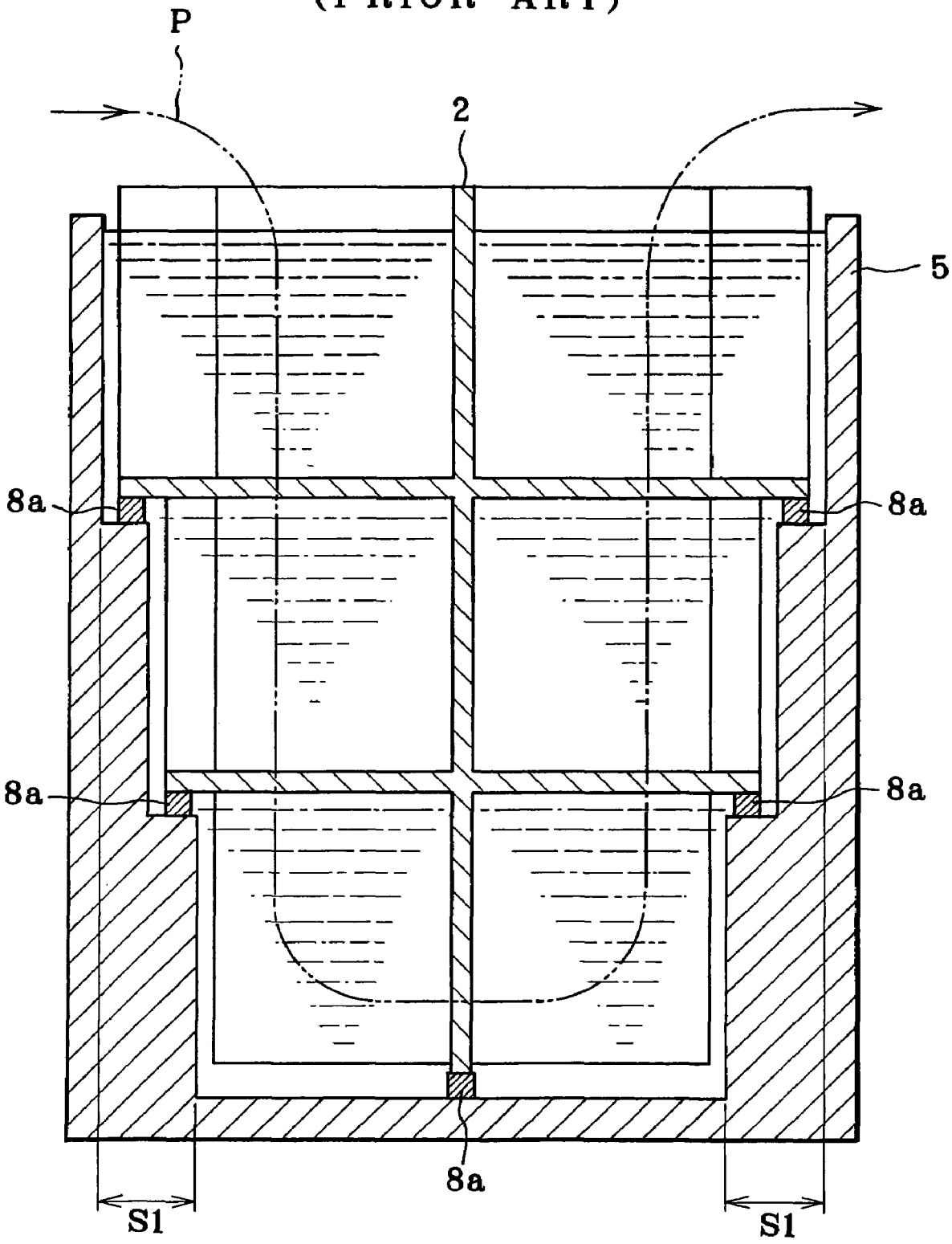
FIG. 13 (PRIOR ART)
FIG. 13 is a vertical section illustrating one sealing method inside a washing bath according to the prior art.
Figure 14:
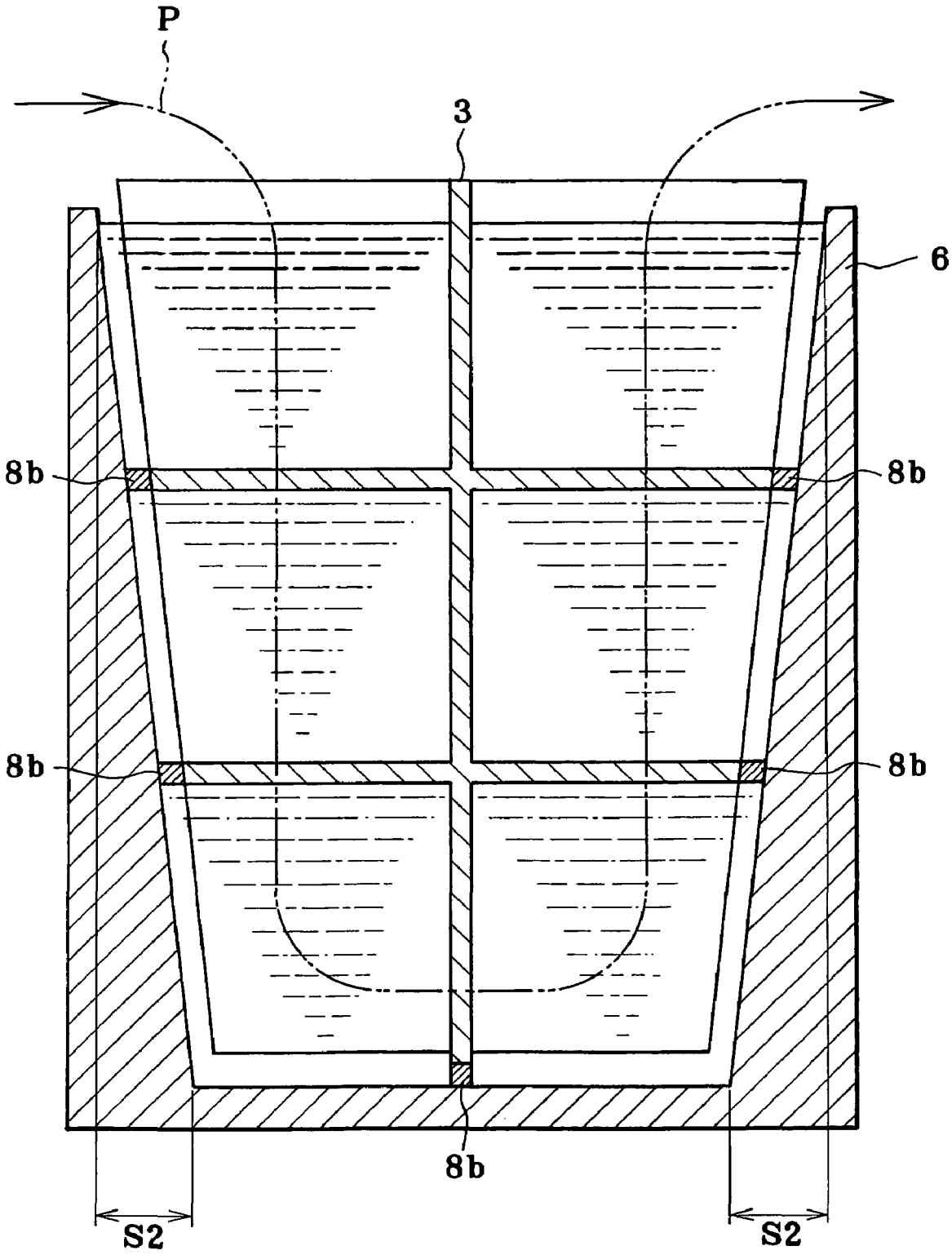
FIG. 14 (PRIOR ART)
FIG. 14 is a vertical section illustrating another sealing method of the prior art by use of a tilted surface.
Figure 15:
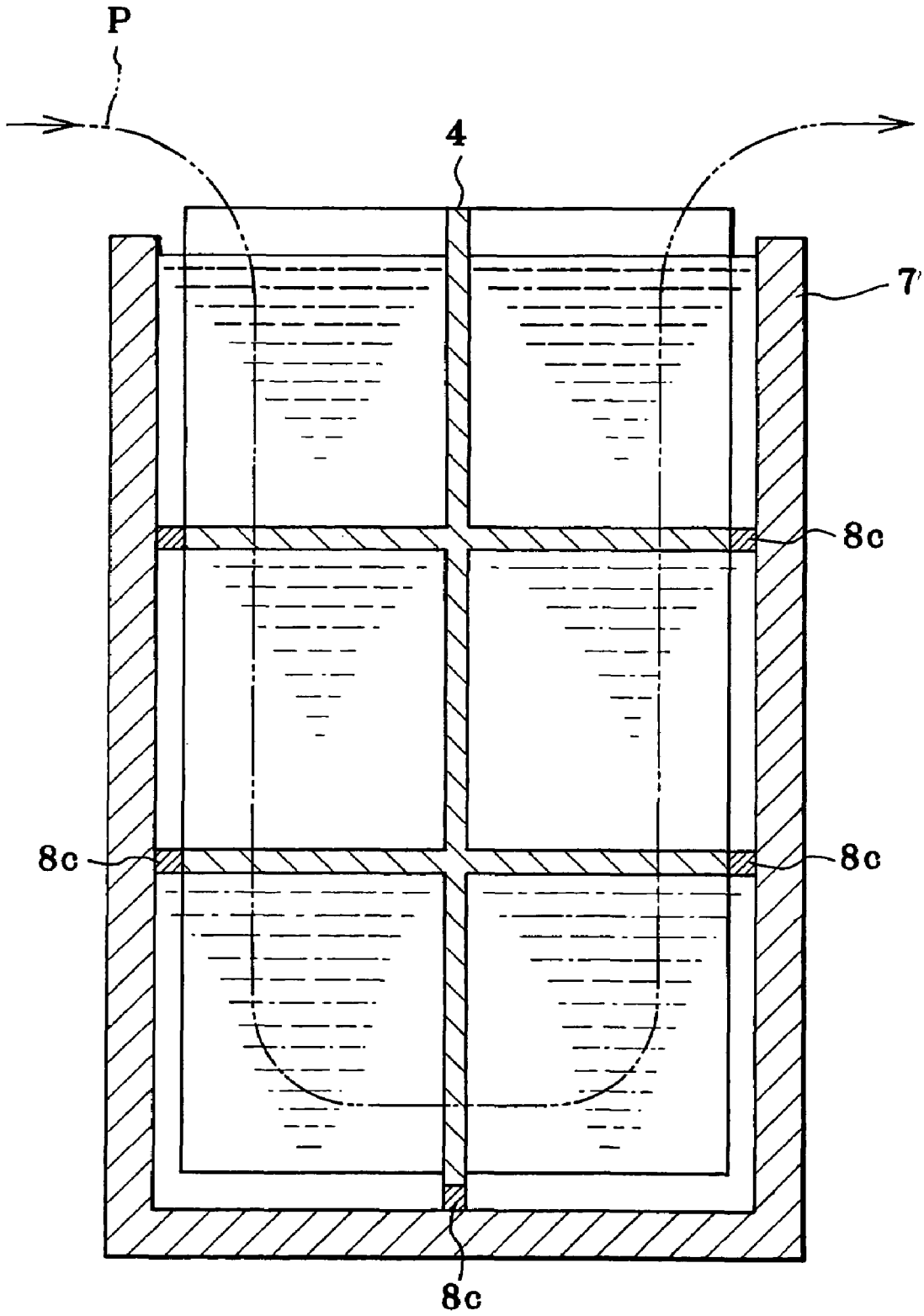
FIG. 15 (PRIOR ART)
FIG. 15 is a vertical section illustrating one sealing method of the prior art by use of a vertical surface.

In general, sealing is made by utilizing pressing load created by repulsion of sealing mediums. In FIGS. 5A, 5C, 5D and 5E, the types of a first group are illustrated, each of which operates according to the pressing load only by resilient deformation of the sealing mediums. In FIGS. 5B, 5F and 5G, in contrast, the types of a second group are illustrated, each of which operates according to the pressing load by a combination of the resilient deformation of the sealing mediums and structural changes of the shapes. Also, the second group enables the coupling between the cell units with low load, so that stress occurring in the bodies of the cell units and other plastic parts can be reduced. This is favorable because of prevention of creep or deformation of the resin, reduction in the stress occurring in the sealing mediums themselves, and fatigue of the material. As surfaces of the coupling exist on the cell units themselves, the coupling is in a two-dimensional orientation, either on the vertical plane or on the horizontal plane. There is no need of surfaces of the coupling in a three-dimensional orientation defined in the X, Y and Z-axes according to the prior art illustrated in FIGS. 13–15. Precision in the coupling does not require being very high. Thus, most of the parts of the cell units, racks, liquid baths and the like can be constructed only from molded articles of resin.

In the above embodiments, the color developing bath 12 is single, the bleach/fixing bath 13 being single, the multi-chamber washing device 14 having the six chambers or partial regions. However, the number of baths for the color developing bath 12, the bleach/fixing bath 13 and the multi-chamber washing device 14 may be changed suitably. In the above embodiments, the multi-chamber washing device 14 has the chambers. However, a bath constituted by chambers according to the invention may be the color developing bath 12 or the bleach/fixing bath 13. Also, each of the color developing bath 12, the bleach/fixing bath 13 and the multi-chamber washing device 14 may be at least one cell. Only one vessel can be used in which the color developing bath 12, the bleach/fixing bath 13 and the multi-chamber washing device 14 can be installed by use of the plural cells for separation in the liquid-tight manner.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A multi-chamber washing device, having plural washing chambers for washing photosensitive material with washing liquid by passage of said photosensitive material through a series thereof, comprising:

a washing bath main vessel for storing said washing liquid;

a washing chamber rack assembly set in said washing liquid in said washing bath main vessel, said washing chamber rack assembly including:

plural cell units, having said washing chambers, and having an opening in an upside thereof;

a cell connection portion for connecting upper and lower ones of said cell units together and substantially vertically, said cell connection portion having first and second connection surfaces, formed on a set of said upper and lower cell units, for closing said opening of said lower cell unit with said upper cell unit;

a sealing medium, disposed at said first connection surface between said cell units by sealing said first and second connection surfaces, for keeping said cell units in a liquid-tight manner, to constitute said washing chambers individually;

a blade mechanism, secured to respectively one of said upper and lower cell units connected by said cell connection portion, for allowing said photosensitive material to pass, and for blocking passage of said washing liquid;

a transporting rack, associated with said cell units, for transporting said photosensitive material, wherein said washing chamber rack assembly comprises at least first and second washing chamber rack assemblies arranged along a transporting path of said photosensitive material, and said photosensitive material moves from an uppermost washing chamber in said first washing chamber rack assembly to a lowest washing chamber therein, and then moves from a lowest washing chamber in said second washing chamber rack assembly to an uppermost washing chamber therein;

a partition panel, disposed between said at least first and second washing chamber rack assemblies, for separating said washing bath main vessel into plural regions; and a partition blade mechanism, incorporated in said partition panel, for allowing said photosensitive material to pass, and for blocking passage of said washing liquid.

2. A multi-chamber washing device as defined in claim 1, wherein said first connection surface has an insertion groove for containing said sealing medium with one portion thereof protruded externally.

3. A multi-chamber washing device as defined in claim 2, wherein said sealing medium comprises an O-ring.

4. A multi-chamber washing device as defined in claim 1, wherein said first and second connection surfaces are substantially horizontally extending connection surfaces, and said first connection surface has an insertion groove for containing said sealing medium with one portion thereof protruded externally.

5. A multi-chamber washing device as defined in claim 4, wherein said sealing medium is in a ring shape, and has a sealing ridge extending along a periphery thereof, said sealing ridge protrudes toward said second connection surface, for liquid-tight sealing by resilient deformation thereof.

6. A multi-chamber washing device as defined in claim 4, wherein said sealing medium is in a ring shape, said second connection surface has a ridge for protruding toward said sealing medium, and is thrust into said sealing medium upon connection of said cell units, for keeping sealed by resilient deformation.

7. A multi-chamber washing device as defined in claim 6, wherein said sealing medium has at least one auxiliary groove, formed therein close to said auxiliary ridge and to extend along a periphery thereof, for encouraging deformation thereof.

8. A multi-chamber washing device as defined in claim 7, wherein said at least one auxiliary groove comprises plural auxiliary grooves between which said auxiliary ridge is disposed.

9. A multi-chamber washing device as defined in claim 1, wherein said first and second connection surfaces are substantially vertically extending connection surfaces, and said first connection surface has an insertion groove for containing said sealing medium with one portion thereof protruded externally.

10. A multi-chamber washing device as defined in claim 9, wherein said sealing medium is in a ring shape, and in an X or V shape as viewed in cross section.

11. A multi-chamber washing device as defined in claim 1, wherein each of said plural washing chamber rack assemblies includes a first cell unit having an uppermost washing chamber to constitute a first one of said washing chambers, and includes a second cell unit disposed to constitute a second one of said washing chambers under said first washing chamber;

wherein a lowest washing chamber is defined by surfaces of said second cell unit, said partition panel and said washing bath main vessel, to constitute a third one of said washing chambers.

12. A multi-chamber washing device as defined in claim 11, wherein said first connection surface has an insertion groove for containing said sealing medium with one portion thereof protruded externally.

13. A multi-chamber washing device as defined in claim 1, wherein each of said washing chamber rack assemblies includes a first cell unit having an uppermost washing chamber to constitute a first one of said washing chambers, includes a second cell unit disposed to constitute a second one of said washing chambers under said first washing chamber, and includes a third cell unit having a lowest washing chamber to constitute a third one of said washing chambers under said second washing chamber.

14. A multi-chamber washing device as defined in claim 13, wherein said first connection surface has an insertion groove for containing said sealing medium with one portion thereof protruded externally.

15. A multi-chamber washing device as defined in claim 1, comprising a first cell unit having an uppermost washing chamber to constitute a first one of said washing chambers, and a second cell unit disposed to constitute a second one of said washing chambers under said first washing chamber, and a third cell unit having a lowest washing chamber to constitute a third one of said washing chambers under said second washing chamber.

16. A multi-chamber washing device as defined in claim 15, wherein said first connection surface has an insertion groove for containing said sealing medium with one portion thereof protruded externally.

17. A multi-chamber washing device as defined in claim 1, wherein said washing chamber rack assembly comprises at least first and second washing chamber rack assemblies, wherein washing chambers commonly included in one of said cell units are arranged along a transporting path of said photosensitive material by setting said washing chamber rack assembly in said washing bath main vessel;

wherein said washing chambers include a first one constituted by an upstream uppermost washing chamber, a second one disposed lower than said first washing chamber, a third one disposed lower than said second washing chamber, a fourth one constituted by a downstream washing chamber downstream from said third washing chamber in a cell unit common therewith, a fifth one disposed higher than said fourth washing chamber, and a sixth one constituted by an uppermost washing chamber disposed higher than said fifth washing chamber.

18. A multi-chamber washing device as defined in claim 17, wherein said first connection surface has an insertion groove for containing said sealing medium with one portion thereof protruded externally.

* * * * *